US011371732B1

(12) United States Patent
Rodrigues et al.

(10) Patent No.: US 11,371,732 B1
(45) Date of Patent: Jun. 28, 2022

(54) HUMIDOR HEAT EXCHANGER SYSTEM AND METHOD FOR USING THEREOF TO CONTROL TEMPERATURE AND RELATIVE HUMIDITY

(71) Applicants: Marcelo Rodrigues, Piracicaba-SP (BR); Luigino Rigitano Netto, Piracicaba-SP (BR); Thomas Andreas Behlau Ziemer, São Paulo-SP (BR)

(72) Inventors: Marcelo Rodrigues, Piracicaba-SP (BR); Luigino Rigitano Netto, Piracicaba-SP (BR); Thomas Andreas Behlau Ziemer, São Paulo-SP (BR)

( * ) Notice: Subject to any disclaimer, the term of this patent is extended or adjusted under 35 U.S.C. 154(b) by 0 days.

(21) Appl. No.: 17/145,222

(22) Filed: Jan. 8, 2021

(51) Int. Cl.
*F24F 11/86* (2018.01)
*F24F 11/00* (2018.01)

(52) U.S. Cl.
CPC ..... *F24F 11/0008* (2013.01); *F24F 11/86* (2018.01)

(58) Field of Classification Search
CPC combination set(s) only.
See application file for complete search history.

(56) References Cited

U.S. PATENT DOCUMENTS 6,094,917 A * 8/2000 Sundhar ..... H01L 35/00 62/3.4
6,122,918 A * 9/2000 Johnson, Jr. ..... A24F 25/02 62/3.6

(Continued)

*Primary Examiner* — Nelson J Nieves

(74) *Attorney, Agent, or Firm* — Intellectual Property Law Group LLP

(57) ABSTRACT

A humidor heat exchanger system and method for using thereof to control temperature and relative humidity are disclosed. The humidor heat exchanger system comprises two or more processors coupled to one or more memories, one or more communication interfaces, one or more thermoelectric modules, one or more compressors, one or more heaters, two or more LEDs, one or more fans, one or more sensors, one or more displays, one or more water collectors, one or more doors, one or more water reservoirs, and one or more evaporators. The two or more processors are communicatively connected to the one or more thermoelectric modules, one or more compressors, one or more heaters, two or more LEDs, one or more fans, one or more sensors, one or more displays, one or more water collectors, one or more doors, and one or more water reservoirs, and one or more evaporators. The two or more processors of the humidor heat exchanger system are configured to control temperature and relative humidity of a humidor by: detecting temperature in the one or more thermoelectric modules; detecting temperature in the one or more evaporators; checking temperature difference between the one or more thermoelectric modules and the one or more evaporators; calculating average temperature value in the one or more thermoelectric modules as to not force the one or more compressors to operate outside a safety region and not be powered on before the necessary period of time to balance cooling circuit pressure; activating the one or more compressors depending on the temperature difference between the one or more thermoelectric modules and the one or more evaporators; dynamically adjusting temperature control parameters as a function of adjusted temperature variation conditions; initiating relative humidity control; checking output of the one or more thermoelectric modules; adjusting power output of the one or more thermoelectric modules to attain desired relative humidity value; and stabilizing relative humidity exactly to the value adjustment made without oscillating about 1%.

18 Claims, 11 Drawing Sheets

(56) References Cited

U.S. PATENT DOCUMENTS

| | | | | |
|---|---|---|---|---|
| 6,157,306 | A * | 12/2000 | Mularoni | G08B 21/182 206/242 |
| 6,308,519 | B1 * | 10/2001 | Bielinski | H01L 35/28 136/203 |
| 6,401,462 | B1 * | 6/2002 | Bielinski | F25B 21/02 62/3.6 |
| 6,729,144 | B1 * | 5/2004 | Kupferman | F25D 11/00 62/3.62 |
| 2019/0041075 | A1 * | 2/2019 | Sarkar | F24F 11/62 |
| 2019/0045842 | A1 * | 2/2019 | Alvez | F24F 6/12 |

* cited by examiner

HUMIDOR HEAT EXCHANGER SYSTEM AND METHOD FOR USING THEREOF TO CONTROL TEMPERATURE AND RELATIVE HUMIDITY

FIELD OF INVENTION

The present disclosure generally relates to climate systems and control methods, and more particularly, to a humidor heat exchanger system and method for controlling temperature and relative humidity.

BACKGROUND OF THE INVENTION

Many devices use temperature and relative humidity control for different applications. The control of these two variables is important to simulate environment conditions found in nature or for maturation, aging or preservation.

There are several ways to control temperature and relative humidity in closed environments. Normally, there is a source of energy for heating and cooling for temperature control and, based on conditions of this system, moisture is injected into these environments.

In climate chambers, for example, the heating sources are electrical resistances and refrigeration is comprised by systems based on compressors with refrigerant gas. The relative humidity control is accomplished by the controlled injection of water vapor using a water boiler with a resistance to vaporize water or a nebulizer that vaporizes water with the aid of a piezoelectric crystal operating at high frequency.

There has been always great difficulty in the state of the art in stabilizing relative humidity because, to keep it at a certain level, there is a need to constantly inject steam from water into the environment. Water vapor injection is needed because, in a closed refrigeration system responsible for lowering temperature, the refrigeration system ends up drawing away the present moisture because it condenses the water vapor in its heat exchanger.

The condensed water in an evaporator is collected and discarded to the external environment. This process of injecting water vapor to control relative humidity becomes complex because the cooling system is of a cyclic, on-off nature. As a result, the amount of water vapor to be injected varies greatly and, consequently, the relative humidity tends to oscillate. The best market devices/systems will oscillate +/1.5% in the control of relative humidity.

Some manufacturers maintain the relative humidity steady by keeping the compressor powered on. This causes the temperature of the internal heat exchanger to be stable. The problem in this situation is that electrical energy and water is wasted. To maintain the relative humidity, water vapor is constantly injected, but this water vapor condenses in the heat exchanger of the refrigeration and is discarded in the external environment. In addition to the large waste of energy and water, there is normally no adequate stability of the relative humidity because the heat exchanger of the refrigeration must be at an exceptionally low temperature.

Another technique used for cooling are thermoelectric cells or Peltier cells. Such components replace conventional refrigeration but have operational limits as a function of their low efficiency. When a device uses the thermoelectric cell in place of the conventional refrigeration system, the manner to control the relative humidity does not change. Some type of water vapor injection is normally used and again for reasons similar to that of the previously described process, humidity control tends to be difficult and there is enough water waste that is condensed and discarded in the process.

In devices that need to operate with high relative humidity values, a different process is used. Within the area to be controlled, a reservoir with water is placed that is in contact with the circulating air. The air that circulates and passes through the reservoir ends up drawing the water vapor. Some manufacturers use a heating resistance within that reservoir to increase the temperature of the water and, thereby, provide more steam to the environment. These devices only control the rise in relative humidity and do not have an element to remove or decrease the relative humidity of the environment.

These are the technologies commonly found above in the state-of-the-art for temperature and relative humidity control. There may be variations in the types of devices used but the principle is always the same, i.e. a control loop for temperature with its components and other control loop for relative humidity and components thereof are provided. These two control loops though always are opposed to each other and cause oscillation in the relative humidity control.

As a function of the quality of the electronic controllers used, the variations of the stabilization point are smaller or larger and each meets a type of market segment with specific needs.

A humidor is a device used for storing and preserving tobacco, cigars, cannabis, and derivatives thereof. For this purpose, an environment with stable relative temperature and humidity are essential for product quality. For example, a cigar that is dry burns too quickly and causes the cigar to have a bitter and/or harsh taste. On the other hand, a damp cigar does not burn easily and is therefore difficult to draw. Therefore, cigars are generally kept in humidors to maintain a relative humidity of about 68-72% to preserve the taste and draw of the cigars. Cigars are, thus, those that require more rigorous control of variables due to their manufacturing characteristics and are extremely sensitive to relative humidity variations. Low relative humidity redries the product and renders it brittle and its aroma properties are lost. High humidity can cause breakage of the skins and degradation of the tobacco.

Accordingly, the need exists for a humidor heat exchanger system and method for using thereof to control temperature and relative humidity that can ensure the best possible environment for preserving the products stored therein, with a relative humidity stabilization better than 1%.

SUMMARY

A first object of the present invention is to provide a humidor heat exchanger system that ensures the best possible environment for preserving products stored therein, with a relative humidity stabilization better than 1%.

A second object of the present invention is to provide a method for controlling temperature and relative humidity in a humidor heat exchanger system.

BRIEF DESCRIPTION OF THE DRAWINGS

The above-mentioned and other features of the invention disclosed herein are described below with reference to the drawings of the preferred embodiments. The illustrated embodiments are intended to illustrate, but not limit, the invention. The drawings contain the accompanying figures.

DETAILED DESCRIPTION OF THE INVENTION

As shown in FIGS. 1 through 11, a humidor heat exchanger system and method for using thereof to control temperature and relative humidity are disclosed.

A first objective of the present invention is to provide the humidor heat exchanger system which represents a novel arrangement whose assembly for extracting heat from a controlled environment for the outdoor air was designed taking into consideration two different refrigeration technologies. In this respect, the present invention takes advantage of the best features of each of these two different refrigeration technologies.

Figure 5:
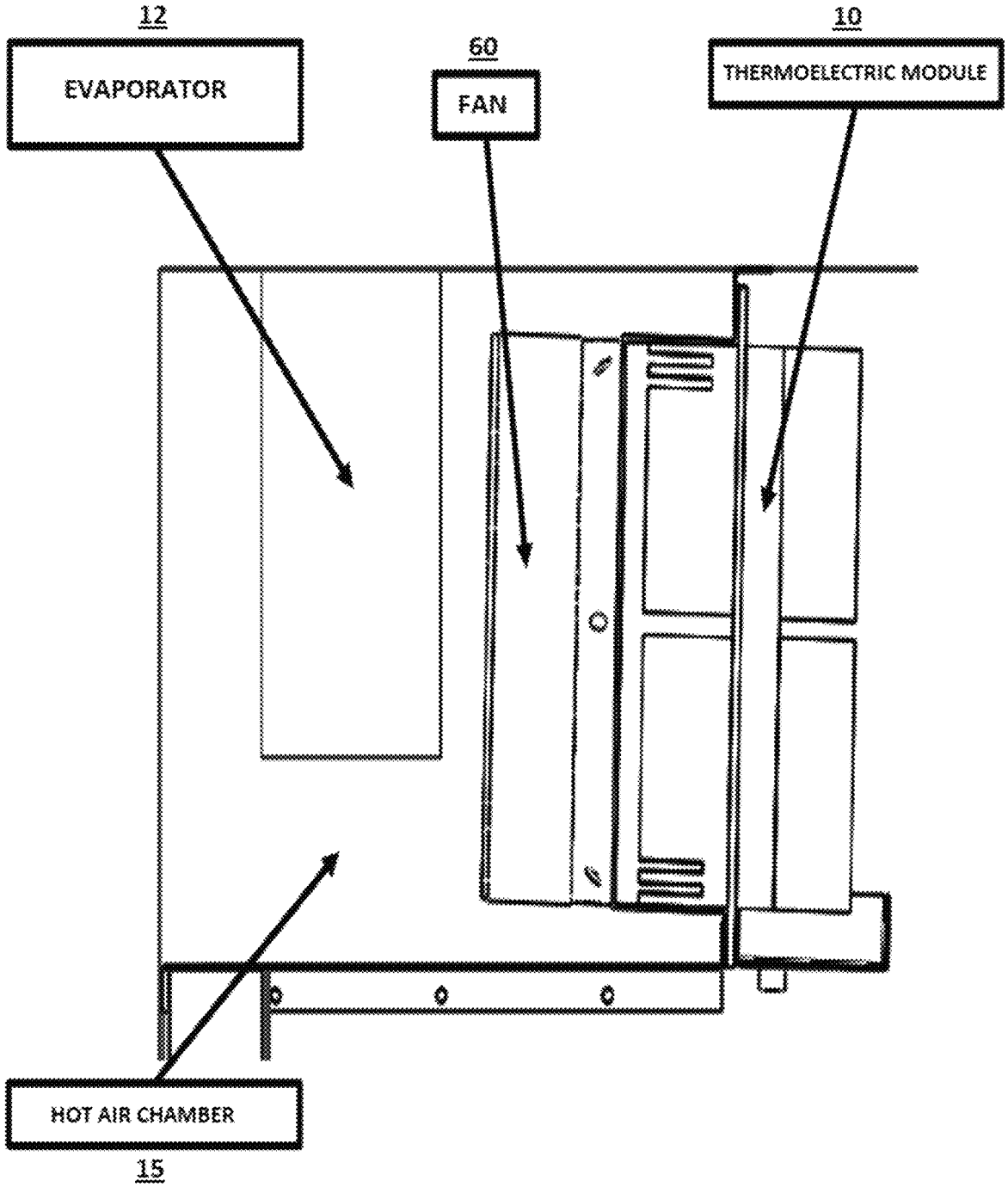
FIG. 5 shows an internal top perspective view of one of the many preferred embodiments of the hot air chamber configuration of the humidor heat exchanger system of the present invention.

A thermoelectric or Peltier cell has the best characteristic for use as a cooling medium of an environment and acts as a heat pump where the electrical voltage applied at its terminals directly controls its ability to exchange heat or cooling capacity. The problem of the thermoelectric cell is its low efficiency when subjected to temperature differences greater than 20° C. between the controlled environment and the external environment. In the present invention, a hot side of the one or more thermoelectric modules is closed in a forced air circulation box called the hot air chamber, as illustrated in FIG. 5. Another element of the hot air chamber is an evaporator which is usually a heat exchanger of a conventional refrigeration system.

The combination of these two heat exchange technologies leads to an improved humidor heat exchanger system which provides greater efficiency because it can operate with large temperature differences between the external environment and the controlled environment, which are typical characteristics of a conventional refrigeration system, and increased temperature stability of the cooling element, which are characteristics of a thermoelectric module.

The stability of the humidor heat exchanger system of the present invention is the ideal cooling element for controlling a closed environment.

To control the temperature and relative humidity of the humidor using the arrangement of the two technologies, a specific control algorithm has been designed and developed.

The heat exchanger system disclosed herein ensures the best possible environment for preserving products stored therein, with a relative humidity stabilization better than 1%.

The humidor heat exchanger system disclosed herein also provides a solution for the control of temperature and relative humidity without causing a constant struggle between its processor controller elements.

More specifically, the humidor heat exchanger system of the present invention in a controlled environment 1, as illustrated in FIGS. 1 through 4, 9 and 10, comprises two or more processors coupled to one or more memories and communicatively connected to one or more communication interfaces 150. The humidor heat exchanger system also comprises one or more thermoelectric modules 10, one or more compressors 20, one or more evaporators 12, one or more heaters 30, two or more LEDs 40, 42, 50, one or more fans 60, 62, one or more sensors 70, 72, 74, 76, one or more displays 110, one or more water collectors 80, one or more doors, one or more water reservoirs 90, and one or more heaters 30. The two or more processors of the humidor heat exchanger system are communicatively connected to the one or more thermoelectric modules 10, one or more compressors 20, one or more evaporators 12, one or more heaters 30, two or more LEDs 40, 42, 50, one or more fans 60, 62, one or more sensors 70, 72, 74, 76, one or more displays 110, one or more water collectors 80, one or more doors, and one or more water reservoirs 90. The two or more processors of the humidor heat exchanger system are configured to control temperature and relative humidity of a humidor by: detecting temperature in the one or more thermoelectric modules 10; detecting temperature in the one or more evaporators 12; checking temperature difference between the one or more thermoelectric modules 10 and the one or more evaporators 12; calculating average temperature value in the one or more thermoelectric modules 10 as to not force the one or more compressors 20 to operate outside a safety region and not be powered on before the necessary period of time to balance cooling circuit pressure; activating the one or more compressors 20 depending on the temperature difference between the one or more thermoelectric modules 10 and the one or more evaporators 12; dynamically adjusting temperature control parameters as a function of adjusted temperature variation conditions; initiating relative humidity control; checking output of the one or more thermoelectric modules 10; adjusting power output of the one or more thermoelectric modules 10 to attain desired relative humidity value; and stabilizing relative humidity exactly to the value adjustment made without oscillating about 1%.

In one of the many preferred embodiments of the present invention, at least one of the two or more processors is a Printed Circuit Board (PCB) controller 100 and at least one of the other of the two or more processors is a Single Board Computer (SBC) 200. Each of the two or more processors may be a single-core processor or a multi-core processor.

In another one of the many preferred embodiments of the present invention, the two or more LEDs comprise one or more UVC (Ultraviolet C) LEDs 40, 42 and one or more lighting LEDs 50. On the other hand, unlike existing systems, the process water circulating in the humidor heat exchanger system disclosed herein is not discarded, and the one or more water reservoirs 90 and the one or more evaporators 20 comprise a germicidal system that keeps the water sterilized and free of fungi and bacteria. Sterilization is done with the one or more UVC LEDs 40, 42. Exposure to this light spectrum ensures exceptionally clean water and eliminates internal air odors.

The one or more memories may store data, executable instructions, modules, components, data structures, etc. The one or more memories can be implemented using computer readable media. Computer-readable media includes at least two types of computer-readable media, namely computer storage media and communications media. Computer storage media includes volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. Computer storage media may also be referred to as "non-transitory" media. Although, in theory, all storage media are transitory, the term "non-transitory" is used to contrast storage media from communication media and refers to a component that can store computer-executable programs, applications, and instructions, for more than a few seconds. In contrast, communication media may embody computer readable instructions, data structures, program modules, or other data in a modulated data signal, such as a carrier wave, or other transmission mechanism. Communication media may also be referred to as "transitory" media, in which electronic data may only be stored for a brief amount of time, typically under one second.

Figure 1:
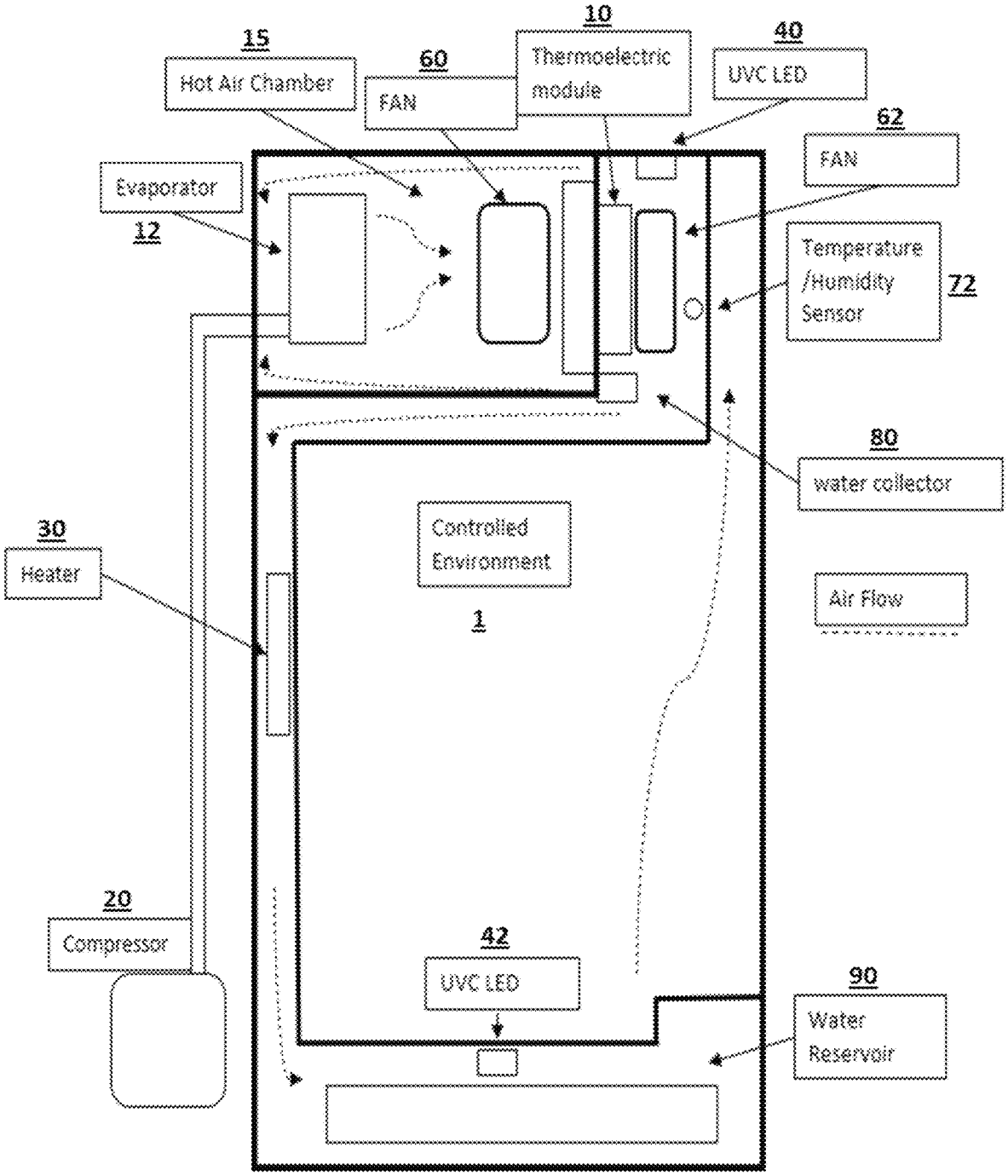
FIG. 1 shows a schematic of one of the many preferred embodiments of the humidor heat exchanger system of the present invention.
Figure 2:
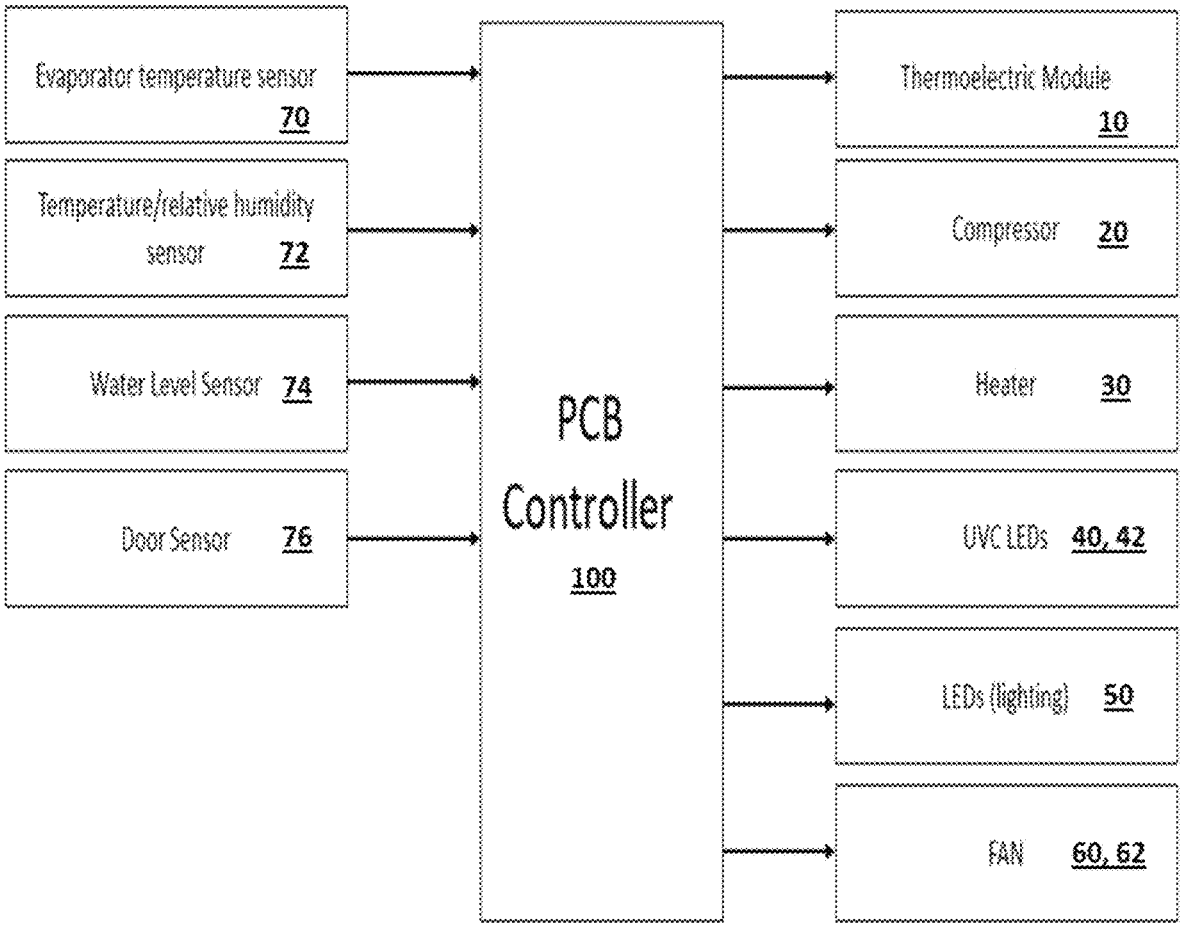
FIG. 2 shows a schematic of one of the many preferred embodiments of the one of the processors' configuration of the humidor heat exchanger system of the present invention.
Figure 3:
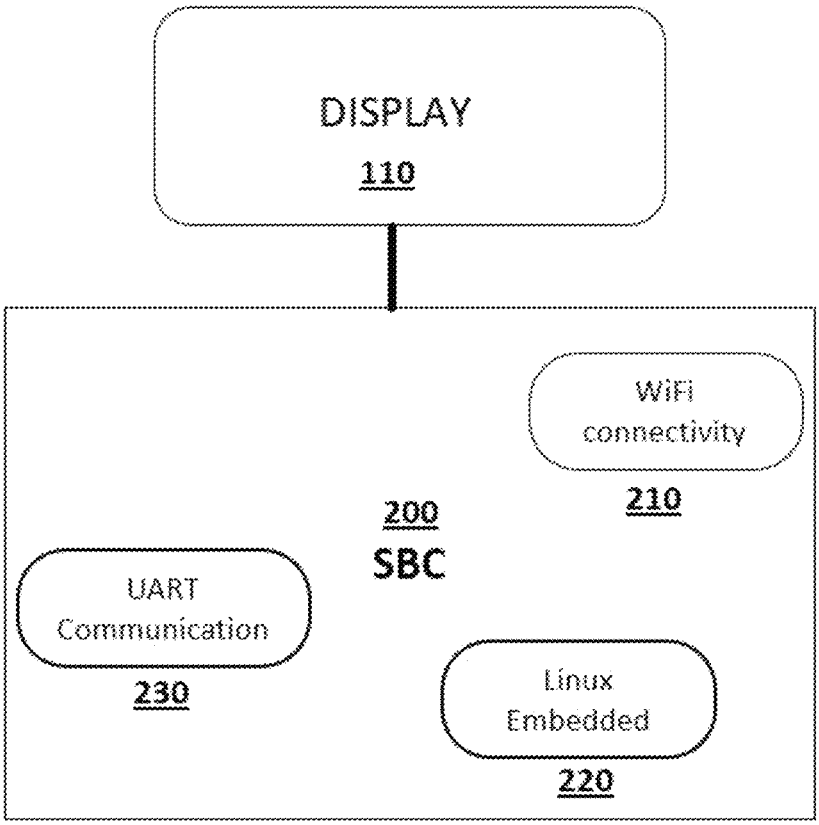
FIG. 3 shows a schematic of one of the many preferred embodiments of the one or the processors' configuration of the present invention.
Figure 4:
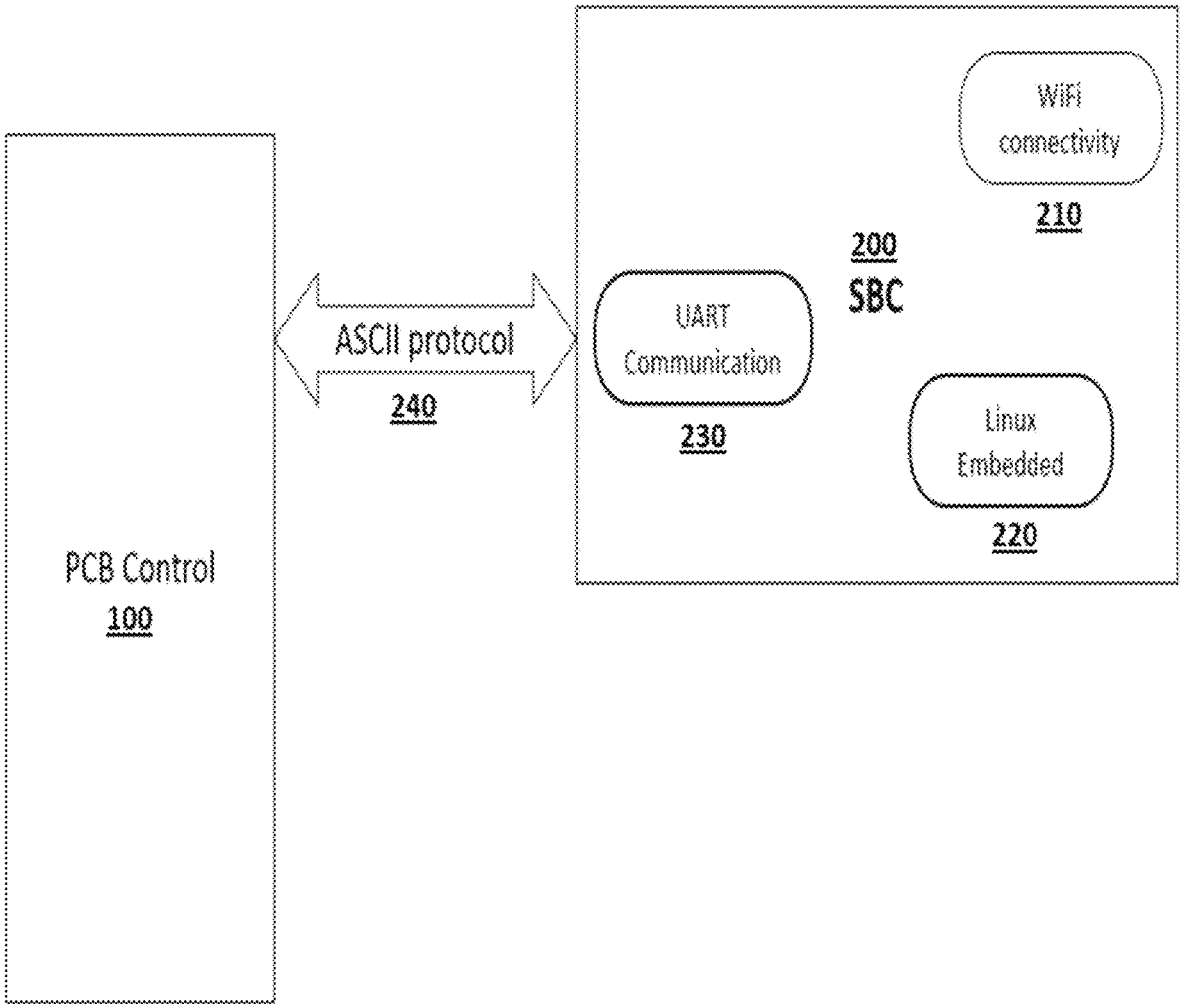
FIG. 4 shows a schematic of one of the many preferred embodiments of the communications configuration between two of the processors of the humidor heat exchanger system of the present invention.

The one or more displays 110 which function as a client user interface for the humidor heat exchanger system may be any sized display screen or also a typical smart phone display or external display used with a smart phone or other type of electronic device. Other client user interface hardware components not shown individually, such as a keyboard, a mouse, a microphone, a camera, and/or the like, may also be included to support client user interface and interaction with the one or more displays or other type of electronic device. In one of the many preferred embodiments of the present invention, as illustrated in FIGS. 3 and 4, the one or more displays 110 may be a 7-inch LCD display with touch screen capabilities managed by the SBC 200, such as the programming of values and displaying the current status of the operation of the humidor heat exchanger system hardware component peripherals.

The one or more communication interfaces 150 facilitate communication with components located outside of the two or more processors 100, 200 and provide networking capabilities for the two or more processors 100, 200. For example, the two or more processors 100, 200, by way of the one or more communications interfaces 150, may exchange data with other electronic devices (e.g., laptops, computers, other servers, etc.) via one or more networks, such as the Internet, a local network or a Wi-Fi network 210. Communications between the two or more processors 100, 200 and other electronic devices may utilize any sort of communication protocol known in the art for sending and receiving data and/or voice communications. In one of the many preferred embodiments of the present invention, as illustrated in FIGS. 3 and 4, the communication interface 150 between the two or more processors including the PCB controller 100 and the SBC 200 may be made a UART-type communications port 230 and the UART-type communications port 230 may operate in an appropriate ASCII-based protocol 240. Likewise, in yet another of the many preferred embodiments of the present invention, in addition to managing the client user interface permitting the programming of values and displaying current status of operation of the hardware, the SBC 200 is responsible for sending data to a server. The server may be a cloud server.

An operating system is stored in the one or more memories of the humidor heat exchanger system. The operating system controls functionality of the two or more processors 100, 200, the one or more communications interfaces 150, the one or more displays, the one or more thermoelectric modules 10, the one or more compressors 20, the one or more heaters 30, the one or more evaporators 12, the two or more LEDs 40, 42, 50, the one or more fans 60, 62, the one or more sensors 70, 72, 74, 76, the one or more water collectors 80, the one or more doors, and the one or more water reservoirs 90. Furthermore, the operating system includes components that enable the two or more processors 100, 200 to receive and transmit data via various inputs (e.g., user controls, network interfaces, and/or memory devices), as well as process data using the two or more processors 100, 200 to generate output. The operating system can also control presentation of output (e.g., display the data, on the one or more displays 110, store the data in the one or more memories, transmit the data to another electronic device, etc.). Additionally, the operating system can include other components that perform various additional functions generally associated with a typical operating system. In one of its many preferred embodiments of the present invention, the operating system is Linux-embedded 220 in the SBC 200.

The one or more memories also stores miscellaneous software applications, or programs, that provide or support functionality for the humidor heat exchanger system or provide a general or specialized system user function that may or may not be related to the humidor heat exchanger system. The software applications include system software applications and executable applications that carry out non-system functions. In one of its many preferred embodiments of the present invention, a C/C++-based firmware is stored and executed in the PCB controller 100 to carry all sensor, input, control and safety component system reading functionalities. The one or more sensors 70, 72, 74, 76 may detect one or more of the following parameters: evaporator temperature, thermoelectric module temperature, relative humidity, water level, and door opening.

In general terms, in one of the many preferred embodiments of the present invention, one of at least two of processors of the present invention, in this case, the PCB controller 100, sends updated data from sensors, inputs, outputs, and processes to the other one of at least two processors, in this case, the SBC 200 that, in turn, organizes the data displays on the one or more displays 110 and sends to the cloud server. The SBC 200 also sends the adjusted data by the user to the PCB controller 100 and manages its operation by forming a verification link for the sake of security of the heat exchanger system. Likewise, the humidor heat exchanger system may be monitored remotely by sending all the operational data to the cloud server. The data is organized and stored in a database and a machine-based algorithm can customize the control of the variables as a function of the usage profile and local conditions.

A second objective of the present invention is to provide the method for controlling temperature and relative humidity in the humidor heat exchanger system comprising the steps of detecting temperature in the one or more thermoelectric modules 10; detecting temperature in the one or more evaporators 12; checking temperature difference between the one or more thermoelectric modules 10 and the one or more evaporators 12; calculating average temperature value in the one or more thermoelectric modules 10 as to not force the one or more compressors 20 to operate outside a safety region and not be powered on before the necessary period of time to balance cooling circuit pressure; activating the one or more compressors 20 depending on the temperature difference between the one or more thermoelectric modules 10 and the one or more evaporators 12; dynamically adjusting temperature control parameters as a function of adjusted temperature variation conditions; initiating relative humidity control; checking output of the one or more thermoelectric modules 10; adjusting power output of the one or more thermoelectric modules 10 to attain desired relative humidity value; and stabilizing relative humidity exactly to the value adjustment made without oscillating about 1%.

Figure 6:
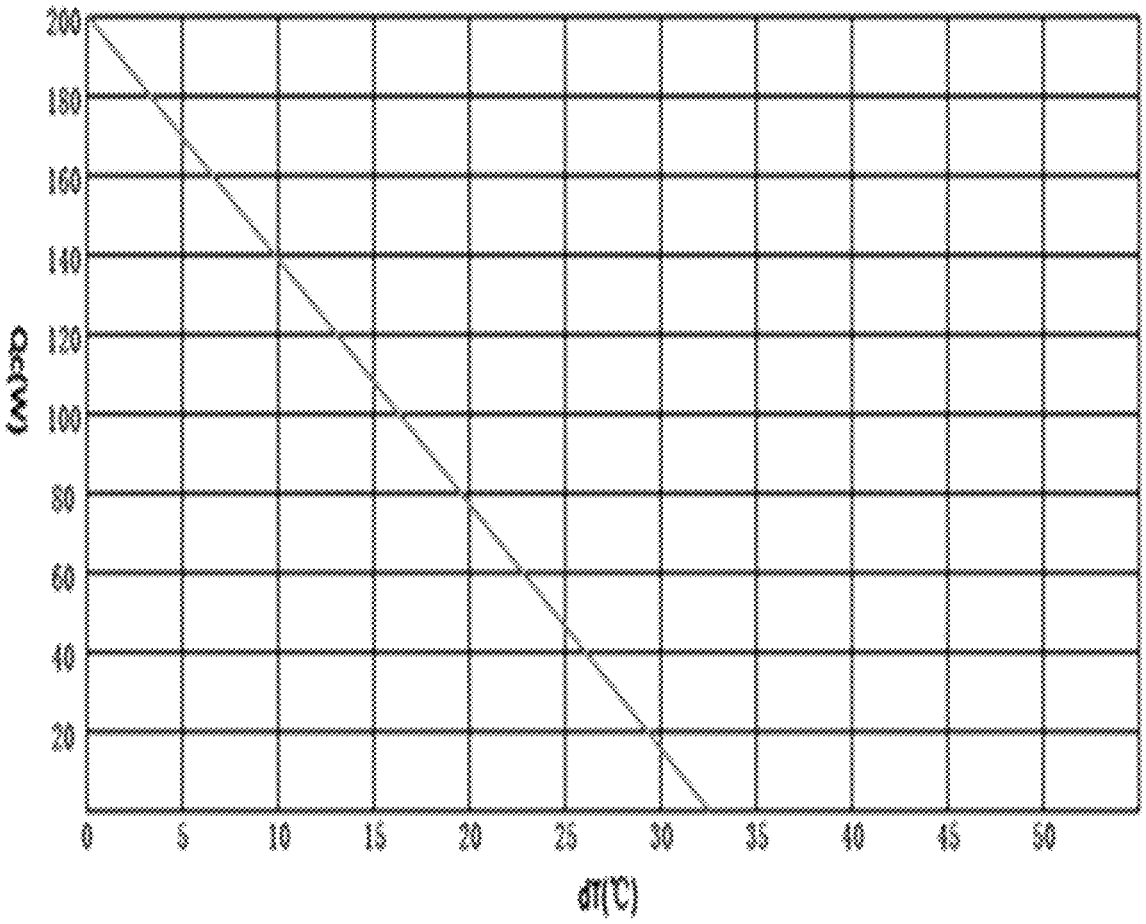
FIG. 6 shows a graphical relationship showing the thermoelectric module efficiency as a function of temperature in a hot side and a cold side in the thermoelectric module of one of the many embodiments of the humidor heat exchanger system of the present invention.

FIG. 6 shows a performance curve of the efficiency ($Q_c$) in watts (W) of the one or more thermoelectric modules 10 as a function of temperature difference (in ° C.) on the hot and cold sides of the one or more thermoelectric modules 10. It is clear from observing the performance curve that the efficiency drops dramatically with the highest temperature difference between the hot side, which is from where heat is given, and the cold side, which is where heat is removed.

Figure 7:
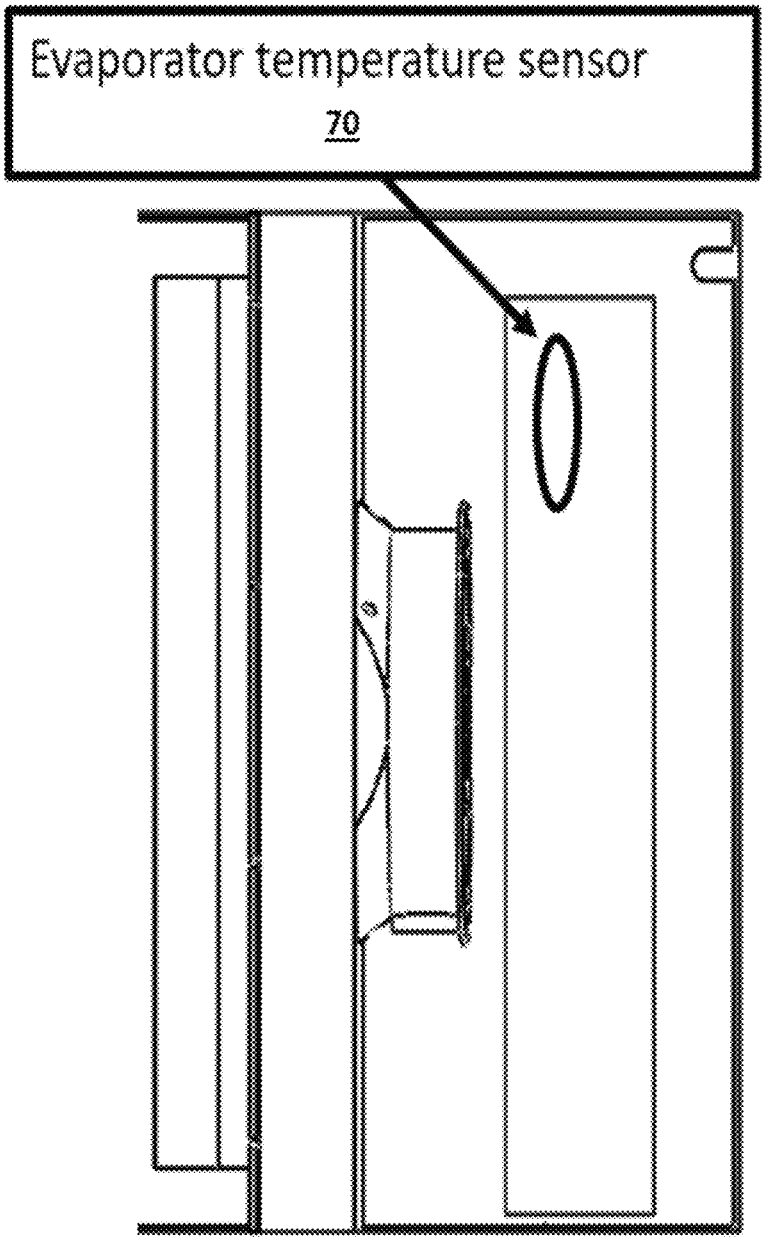
FIG. 7 shows an internal top perspective view of one of the many preferred embodiments of the hot air chamber configuration of the humidor heat exchanger system of the present invention.

To keep the one or more thermoelectric modules 10 always the most efficient possible, a temperature sensor 70 is installed on the hot side (installed inside evaporator) of the one or more thermoelectric modules 10, as illustrated in FIG. 7. With this installed sensor 70, it is possible to always know the temperature of the hot side of the one or more thermoelectric modules 10. Although not physically in contact with the hot side of the one or more thermoelectric modules 10, the temperature condition is the same as if it were in physical contact with the one or more thermoelectric modules 10. The other side of the one or more thermoelectric modules 10, the cold side, is in direct contact with the environment that is desired to be controlled. The reading of the environmental sensor 72 brings the temperature information from the cold side.

The process control algorithm always checks this temperature difference and controls the actuation of the one or more refrigeration compressors 20 so that the temperature of the hot side is always as close as possible to the cold side. In doing so, the one or more thermoelectric modules 10 operate always in a maximum efficiency region because the temperature difference between the two sides of the one or more thermoelectric modules 10 is always close to a null value.

As the temperature in the one or more evaporators 12 oscillates as a function of the actuation of the one or more compressors 20, the algorithm calculates the average value in the period to not force the one or more refrigeration compressors 20 to operate outside of its safety region and not be powered on before the time required to balance the cooling circuit pressures.

Figure 8:
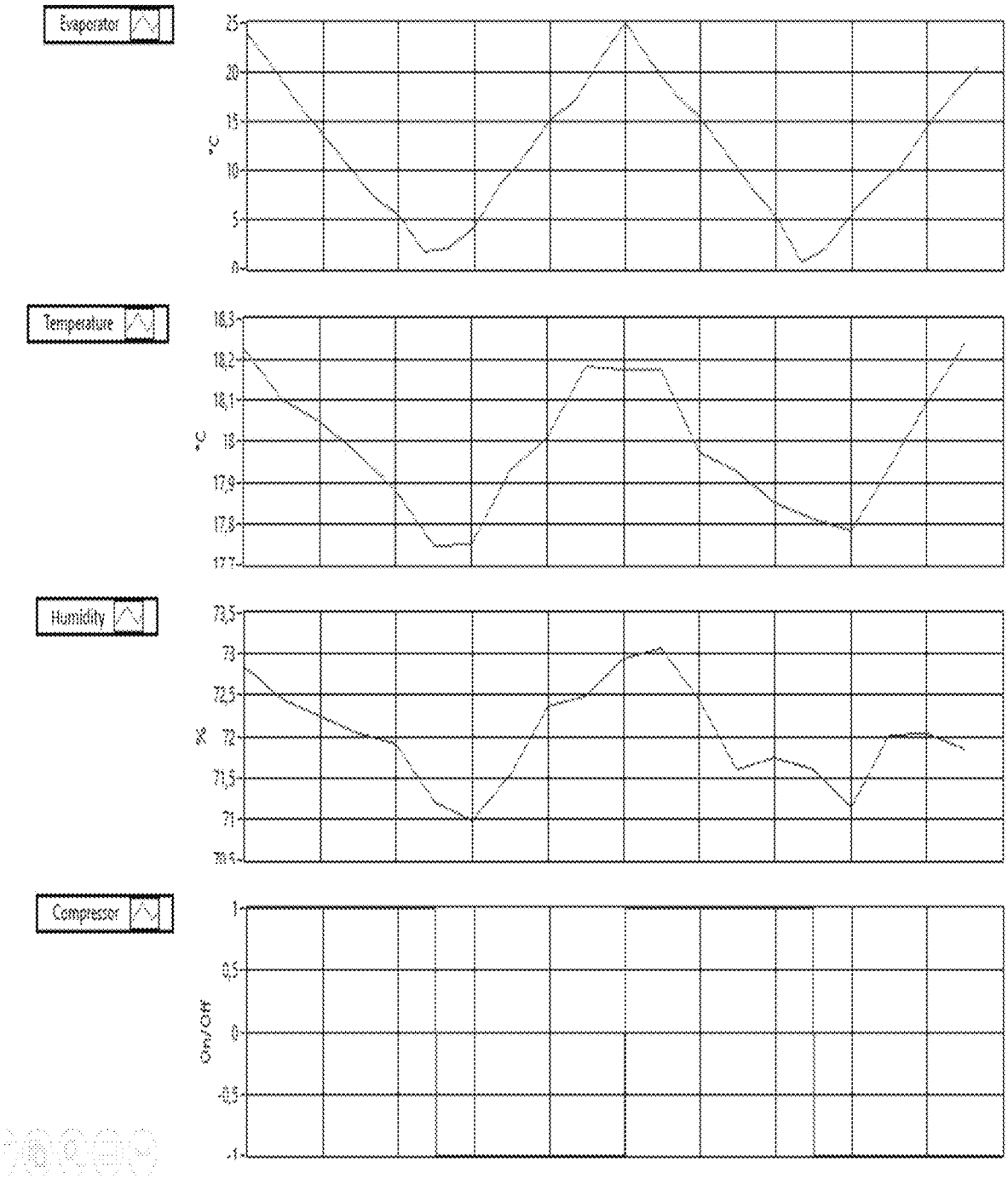
FIG. 8 shows graphical relationships showing sensor readings of operating conditions in the hot air chamber configuration of one of the many embodiments of the humidor heat exchanger system of the present invention.

FIG. 8 shows a graphical representation illustrating the evaporator temperature variation in the hot air chamber 15 as a function of compressor actuation. The data was captured from a display 110 mounted in a particular software application, in this case, LabView software, where independent sensors were installed and connected to a PC to monitor the operating conditions of the hot air chamber 15. A sensor was placed in the same position as the sensor of the control system.

Temperature and humidity plots were obtained from a sensor placed within the controlled environment 1 of the humidor. The latter graph in FIG. 8 also shows the driving moment of the one or more refrigeration compressors 20. This graph is a sample of the process that was used to validate the algorithm executed by the PCB controller 100 to control the temperature of the hot air chamber 15.

Temperature and Relative Humidity Control within the Humidor

The temperature and relative humidity control are based on one of the at least two or more processors of the present invention, in this case, the PCB controller 100. As described before, the ARM processor located on the PCB controller 100 runs a C/C++ based firmware that has all of the functions for sensing inputs and sensors, control and security of the system components.

An algorithm was developed to be run in the PCB controller 100 utilizing a Proportional Integral Derivative (PID) control loop mechanism, but the control parameters are dynamically adjusted as a function of the current conditions obtained by the one or more sensors 70, 72, 74, 76 installed inside the humidor heat exchanger system.

Figure 9:
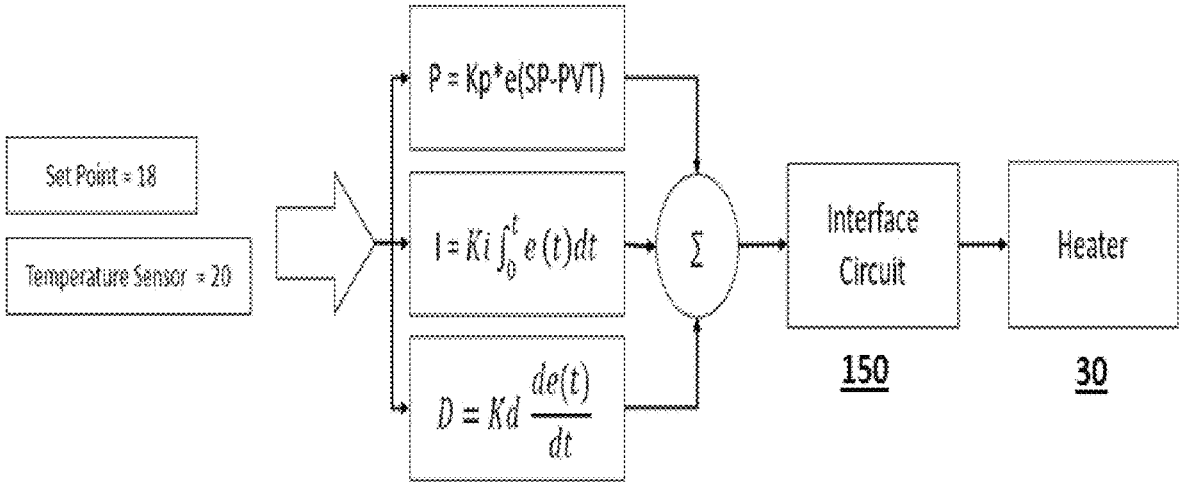
FIG. 9 shows a PID control loop mechanism for temperature control of one of the many embodiments of the humidor heat exchanger system of the present invention.

As a starting point and illustrative example of executing the control algorithm and as illustrated in FIG. 9, a common temperature and humidity adjustment in the humidor is set:

Temperature=18° C.

Relative Humidity=72%

The temperature setpoint of 18° C. is an input of the PID control loop mechanism for temperature control, and the other input is the actual value of the temperature of the humidor.

The temperature PID control loop consists of reading the temperature sensor 72 of the environment and then acts on the heating resistance. The control of the process is based on a conventional PID control loop mechanism and the output acts to control the power of the resistance in a proportional fashion. The values are processed by the PID control loop mechanism and its mathematical output is converted and modulated in power to the heating resistance in the one or more heaters 30.

Since the hot air chamber 15 has the temperature variation values set, the one or more thermoelectric modules 10 will be at their most efficient point of operation and, only after this established condition, the relative humidity control is initiated.

Figure 10:
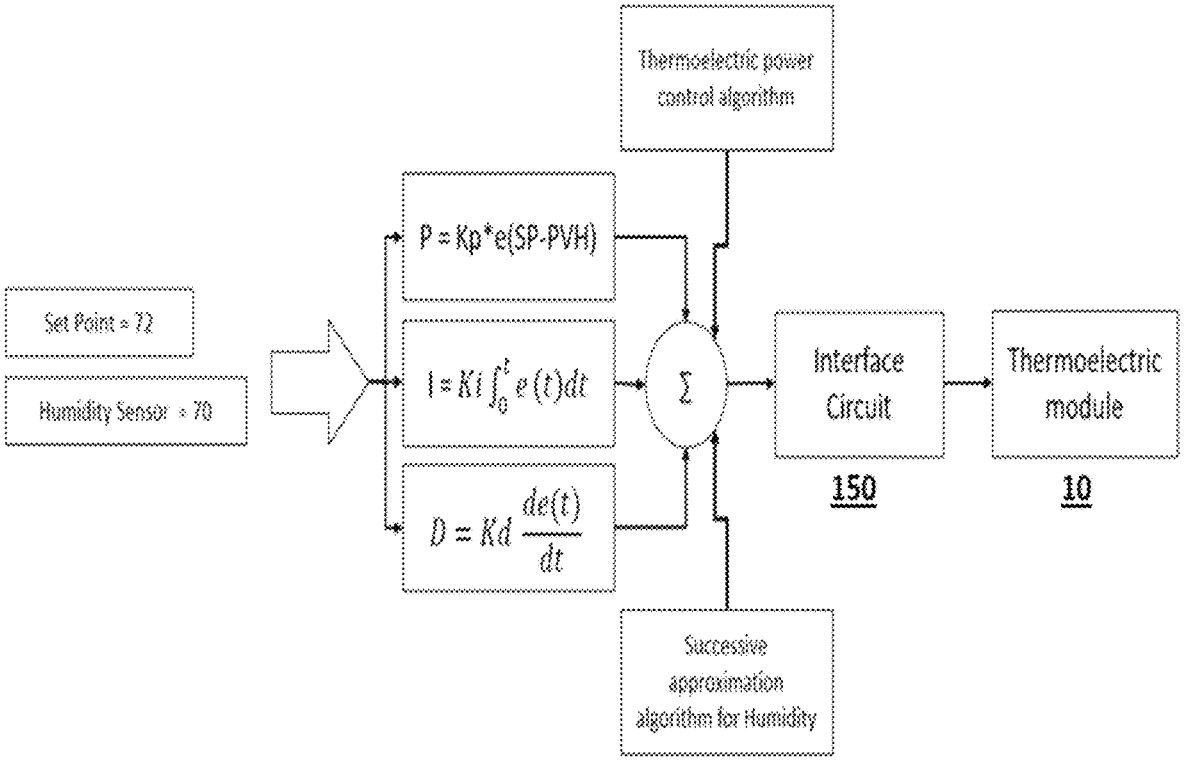
FIG. 10 shows a PID control loop mechanism for relative humidity control of one of the many embodiments of the humidor heat exchanger system of the present invention.

For the relative humidity control as illustrated in FIG. 10, the process value of the PID control loop mechanism is the relative humidity itself. There is an additional algorithm to the PID control loop mechanism that causes the setpoint value to be adjusted to correct for deviations. This value is automatically adjusted by a moving average calculated with the current relative humidity value, if the value is somewhat below or above, and the PID deviation value is adjusted inversely to correct for this deviation.

This correction is made smartly and performed only after there is stability at the output of the PID control loop mechanism of the relative humidity. This stability is detected by a timer that is triggered only when the PID control loop mechanism output is within certain limits. If the output remains at these limits for more than two minutes, then it is an indication that the stabilization point has been reached. The process of comparing the setpoint value with the current process value is then initiated. If there is any deviation, the value is corrected at the PID deviation. This additional control algorithm to the PID loop control mechanism is called the Succeeding Approximation Algorithm for Humidity. This algorithm makes something that is not common in the marketplace and in the state-of-the-art and that is stabilizing relative humidity exactly to the value adjustment made without oscillating about 1%.

Yet another algorithm is also employed to assure that there is no excess of power applied to the one or more thermoelectric modules 10. This algorithm checks the output of the PID control loop mechanism for the one or more thermoelectric modules 10. If the one or more thermoelectric modules 10 stay above 80% for a given period of time, the process input values are checked, and the value is set from the relative humidity and the adjustment is made. If the user has changed the adjustment or if this difference has risen after an opening of the one or more doors detected by its corresponding door sensor 76, the algorithm then limits the maximum power to be sent and applied to the one or more thermoelectric modules 10. The function of this limitation is to avoid excessive power consumption of the one or more compressors 20. With the power consumption being limited, a slightly greater period of time is required to achieve the desired relative humidity value. This delay is beneficial for the entire system because it prevents excessive energy consumption and promotes a smoother change in relative humidity value.

Whenever the humidor heat exchanger system is turned on and a control process is initiated, the first block to be activated is the one dealing with the relative humidity. This is because it has been proven during various tests that the cold side temperature of the one or more thermoelectric modules 10 is always below the selected/set temperature due to the physical property of the dew point. The reason for existing and state-of-the-art heat transfer systems to oscillate is the non-observation of this physical principle. The relative humidity emanates from the temperature of the heat exchanger cooling system, or dew point temperature, the two magnitudes being inherently linked.

Once the humidity control block is activated, it searches for the adjusted humidity value. After reaching that value, the temperature control block is then activated.

This algorithm has been created to cause the heat exchanger system to stabilize exactly the selected value without oscillations. The result can only be obtained as a function of the cooling methodologies developed using two distinct technologies.

Machine Learning in the Control of Relative Humidity

Whenever the point of equilibrium of relative humidity is reached, i.e., that point where it is stable within the adjusted value without oscillating, all current values relating to the control blocks are saved in the internal memory of the ARM processor and sent to the cloud server.

Figure 11:
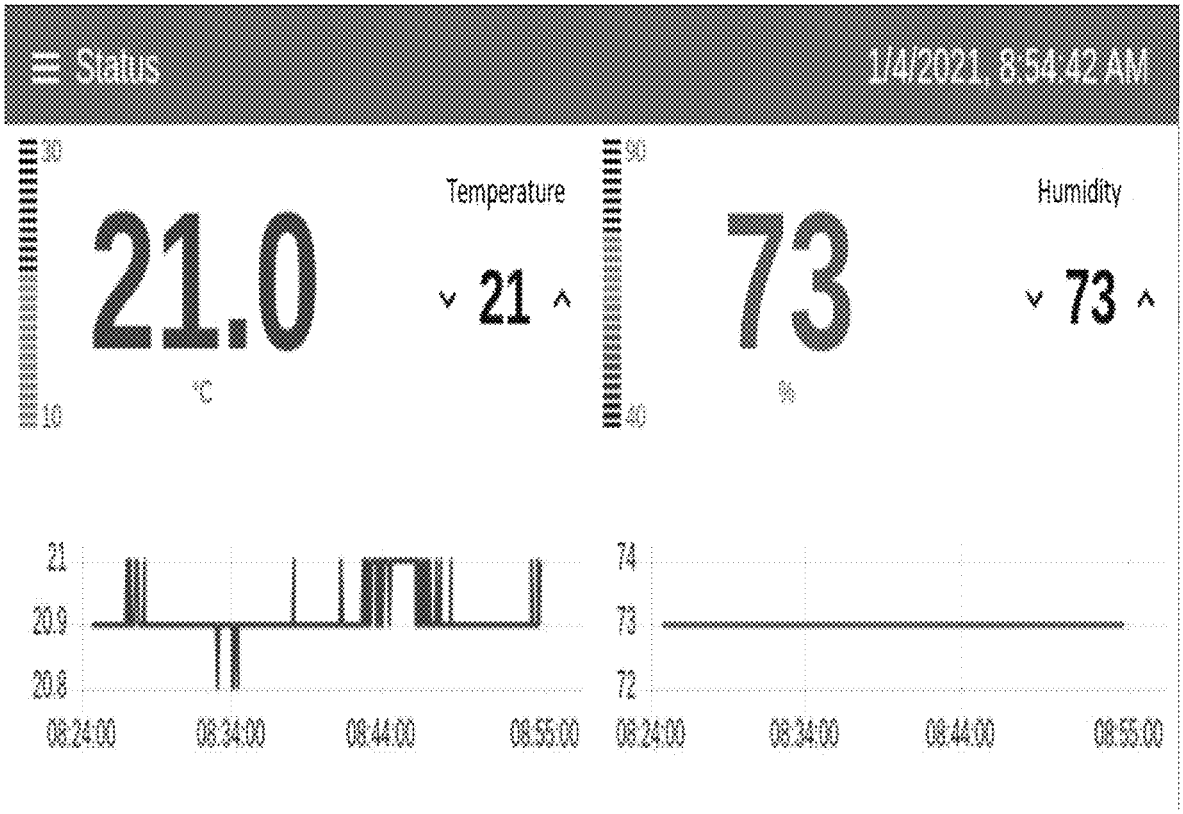
FIG. 11 shows graphical relationships evidencing cloud server data of the stabilization of temperature and relative humidity as well as the PID control block output in real time of one of the many embodiments of the humidor heat exchanger system of the present invention.

As illustrated in FIG. 11, the saved data illustrate an image of how to control the humidor heat exchanger system of the present invention with precision. With the data sent and housed in the cloud server, these data will be compared with data from other humidor heat exchanger systems in operation and this information will make up a table and reference values that will be applied to humidor heat exchanger systems in the process of being manufactured. The adjusted values and environment conditions external to the humidor heat exchanger system are taken into consideration. The objective is to obtain a model using machine learning that can be applied to the humidor heat exchanger system remotely. That, in turn, automatically allows, whenever there is external interference, the humidor heat exchanger system to be able, by way of the parameters obtained by this process, to stabilize the variables more quickly and efficiently.

Although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of the invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of at least some of the embodiments of the present invention herein described should not be limited by the disclosed embodiments described above.

What is claimed is:

1. A humidor heat exchanger system, comprising:

two or more processors coupled to one or more memories and communicatively connected by one or more communication interfaces;

one or more thermoelectric modules;

one or more compressors;

one or more heaters;

one or more evaporators;

two or more LEDs;

one or more fans;

one or more sensors;

one or more displays;

one or more water collectors;

one or more doors; and one or more water reservoirs;

wherein the two or more processors are communicatively connected to the one or more thermoelectric modules, one or more compressors, one or more heaters, two or more LEDs, one or more fans, one or more sensors, one or more displays, one or more water collectors, one or more doors, one or more water reservoirs and one or more evaporators; and wherein the two or more processors are configured to control temperature and relative humidity of a humidor by:

detecting temperature in the one or more thermoelectric modules;

detecting temperature in the one or more evaporators;

checking temperature difference between the one or more thermoelectric modules and the one or more evaporators;

calculating average temperature value in the one or more thermoelectric modules as to not force the one or more compressors to operate outside a safety region and not be powered on before a necessary period of time to balance cooling circuit pressure;

activating the one or more compressors depending on the temperature difference between the one or more thermoelectric modules and the one or more evaporators;

dynamically adjusting temperature control parameters as a function of adjusted temperature variation conditions;

initiating relative humidity control;

checking a PID control output of the one or more thermoelectric modules;

adjusting power output of the one or more thermoelectric modules to attain desired relative humidity value; and stabilizing relative humidity exactly to a value adjustment made without the relative humidity oscillating about 1%.

2. The humidor heat exchanger system in accordance with claim 1, wherein at least one of the two or more processors is a Printed Circuit Board (PCB) controller and at least one of the other of the two or more processors is a Single Board Computer (SBC), and wherein the two or more LEDs comprise one or more UVC LEDs and one or more lighting LEDs.

3. The humidor heat exchanger system in accordance with claim 1, wherein the one or more water collectors, the one or more evaporators and the one or more water reservoirs do not discard process water, and wherein the one or more water reservoirs and the one or more evaporators comprise a germicidal system that keeps the water sterilized and free of fungi and bacteria by means of one or more UVC LEDs which ensures clean water and eliminates internal air odors.

4. The humidor heat exchanger system in accordance with claim 1, wherein the one or more sensors may be fitted in a hot side of the one or more thermoelectric modules, and wherein the one or more sensors may detect one or more of the following parameters: evaporator temperature, thermoelectric module temperature, relative humidity, water level, and door opening.

5. The humidor heat exchanger system in accordance with claim 1, wherein the one or more communications interfaces comprise an UART-type communications port, and wherein the UART-type communications port operates in an appropriate ASCII-based protocol.

6. The humidor heat exchanger system in accordance with claim 1, wherein the one or more displays comprise any sized LCD display screen.

7. The humidor heat exchanger system is accordance with claim 1, wherein the two or more processors adjusting power output of the one or more thermoelectric modules to attain desired relative humidity value comprise the two or more processors averaging dynamically an actual relative humidity once there is a PID control output stability of the relative humidity detected by a timer activated when PID control output is within a threshold.

8. The humidor heat exchanger system is accordance with claim 1, wherein the two or more processors adjusting power output of the one or more thermoelectric modules to attain desired relative humidity value comprise the two or more processors determining that, if the PID control output remains within a threshold for more than two minutes, then it is an indication that the stabilization point has been reached.

9. The humidor heat exchanger system in accordance with claim 1, wherein the two or more processors adjusting power output of the one or more thermoelectric modules to attain desired relative humidity value comprise the two or more processors initiating comparison between set point value and actual value which leads to a correction of the set point value if there is any deviation, if PID control output remains within threshold.

10. The humidor heat exchanger system in accordance with claim 1, wherein the two or more processors are further configured to customize the control of the temperature and relative humidity variables as a function of usage profile and local conditions through machine learning.

11. The humidor heat exchanger system in accordance with claim 2, wherein the SBC sends data to a cloud server, organizes data displayed in a screen of the one or more displays, and sends user-adjusted data to the PCB controller.

12. A method for controlling temperature and relative humidity in a humidor heat exchanger system including two or more processors coupled to one or more memories, one or more communication interfaces, one or more thermoelectric modules, one or more compressors, one or more heaters, one or more evaporators, two or more LEDs, one or more fans, one or more sensors, one or more displays, one or more water collectors, one or more doors, and one or more water reservoirs, the method comprising the following steps:

detecting temperature in the one or more evaporators;

checking temperature difference between the one or more thermoelectric modules and the one or more evaporators;

calculating average temperature value in the one or more thermoelectric modules as to not force the one or more compressors to operate outside a safety region and not be powered on before a necessary period of time to balance cooling circuit pressure;

activating the one or more compressors depending on the temperature difference between the one or more thermoelectric modules and the one or more evaporators;

dynamically adjusting temperature control parameters as a function of adjusted temperature variation conditions;

initiating relative humidity control;

checking a PID control output of the one or more thermoelectric modules;

adjusting power output of the one or more thermoelectric modules to attain desired relative humidity value; and stabilizing relative humidity exactly to a value adjustment made without the relative humidity oscillating about 1%.

13. The method in accordance with claim 12, wherein adjusting power output of the one or more thermoelectric modules to attain desired relative humidity value comprises averaging dynamically an actual relative humidity once there is PID control output stability of the relative humidity detected by a timer activated when PID control output is within a threshold.

14. The method in accordance with claim 12, wherein adjusting power output of the one or more thermoelectric modules to attain desired relative humidity value comprises determining that, if the PID control output remains within a threshold for more than two minutes, then it is an indication that the stabilization point has been reached.

15. The method in accordance with claim 12, wherein adjusting power output of the one or more thermoelectric modules to attain desired relative humidity value comprises initiating comparison between set point value and actual value which leads to a correction of the set point value if there is any deviation, if PID control output remains within threshold.

16. The method in accordance with claim 12, further comprising customizing the control of the temperature and relative humidity variables as a function of usage profile and local conditions through machine learning.

17. The method in accordance with claim 12, further comprising sending data to a cloud server by one of the at least two or more processors, organizing data displayed in the one or more displays by one of the at least two or more processors, and sending user-adjusted data by one of the two or more processors to the other one of the two or more processors.

18. The method in accordance with claim 12, further comprising not discarding process water, and keeping the process water sterilized and free of fungi and bacteria by means of one or more UVC LEDs which ensures clean water and eliminates internal air odors.

* * * * *